US012402690B2

(12) United States Patent
Fauconnier et al.

(10) Patent No.: US 12,402,690 B2
(45) Date of Patent: Sep. 2, 2025

(54) SHOE WITH FOAM PODS AND CHASSIS

(71) Applicant: PUMA SE, Herzogenaurach (DE)

(72) Inventors: Sidney Fauconnier, Nuremberg (DE); Romain Girard, Lauf an der Pegnitz (DE)

(73) Assignee: PUMA SE, Herzogenaurach (DE)

( * ) Notice: Subject to any disclaimer, the term of this patent is extended or adjusted under 35 U.S.C. 154(b) by 150 days.

(21) Appl. No.: 17/963,482

(22) Filed: Oct. 11, 2022

(65) Prior Publication Data

US 2023/0123301 A1 Apr. 20, 2023

Related U.S. Application Data

(60) Provisional application No. 63/256,874, filed on Oct. 18, 2021.

(51) Int. Cl.

| | |
|---|---|
| ***A43B 13/18*** | (2006.01) |
| ***A43B 13/12*** | (2006.01) |
| ***A43B 13/37*** | (2006.01) |

(52) U.S. Cl.

CPC ..... *A43B 13/187* (2013.01); *A43B 13/125* (2013.01); *A43B 13/37* (2013.01)

(58) Field of Classification Search

CPC ..... A43B 13/187; A43B 13/125; A43B 13/37; A43B 13/188; A43B 13/183; A43B 13/185; A43B 13/122; A43B 13/186; A43B 7/223

See application file for complete search history.

(56) References Cited

U.S. PATENT DOCUMENTS

| | | | |
|---|---|---|---|
| 6,457,263 | B1 | 10/2002 | Rudy |
| 6,665,958 | B2 | 12/2003 | Goodwin |
| 6,944,973 | B2 | 9/2005 | Goodwin |
| 7,200,955 | B2 | 4/2007 | Foxen |
| 7,694,437 | B2 | 4/2010 | Hogan |

(Continued)

FOREIGN PATENT DOCUMENTS

| | | |
|---|---|---|
| CN | 102729502 | 10/2012 |
| CN | 105192992 | 12/2015 |

(Continued)

OTHER PUBLICATIONS

International Search Report and Written Opinion for International Application No. PCT/IB2022/059752, mailed Feb. 2, 2023 (17 pages).

*Primary Examiner* — Jameson D Collier

(74) *Attorney, Agent, or Firm* — Quarles & Brady LLP

(57) ABSTRACT

An article of footwear includes a sole structure coupled with an upper that defines a forefoot region, a midfoot region, and a heel region. The sole structure includes a plurality of pods that each have a pod body formed from a foam material that optionally has a coating disposed on an outer surface of the pod body. The sole structure includes a chassis attached to a bottom surface of each of the plurality of pods. The chassis includes a plurality of ground contacting regions and an elongated fork structure. The elongated fork structure includes a chassis stem, a first chassis leg, and a second chassis leg that each extend from the chassis stem through the heel region, the midfoot region, and the forefoot region of the sole structure. A continuous elongated groove is positioned between and extends along substantially the entire length of the first and second chassis leg.

16 Claims, 8 Drawing Sheets

(56) References Cited

U.S. PATENT DOCUMENTS

| | | | | |
|---|---|---|---|---|
| 7,694,438 | B1 | 4/2010 | Christensen | |
| 8,151,485 | B2 | 4/2012 | Hurd | |
| 8,178,022 | B2 | 5/2012 | Schindler | |
| 8,241,450 | B2 | 8/2012 | Hensley | |
| 8,256,141 | B2 | 9/2012 | Christensen | |
| 8,266,826 | B2 | 9/2012 | Cassiday | |
| 8,453,344 | B2 | 6/2013 | Nishiwaki | |
| 8,479,412 | B2 | 7/2013 | Peyton | |
| 8,490,296 | B2 | 7/2013 | Hurd | |
| 8,782,924 | B2 | 7/2014 | Peyton | |
| 8,863,407 | B2 * | 10/2014 | Nishiwaki | A43B 13/141 36/27 |
| 8,863,408 | B2 | 10/2014 | Schindler | |
| 8,919,013 | B2 | 12/2014 | Christensen | |
| 8,943,709 | B2 | 2/2015 | Aveni | |
| 8,978,272 | B2 | 3/2015 | Hurd | |
| 8,978,273 | B2 | 3/2015 | Cook | |
| 9,066,556 | B2 | 6/2015 | Peyton | |
| 9,066,557 | B2 | 6/2015 | Peyton | |
| 9,089,185 | B2 * | 7/2015 | Nishiwaki | A43B 13/12 |
| 9,144,266 | B2 | 9/2015 | Christensen | |
| 9,179,733 | B2 | 11/2015 | Peyton | |
| 9,265,302 | B2 | 2/2016 | Peyton | |
| 9,271,544 | B2 | 3/2016 | Peyton | |
| 9,289,030 | B2 | 3/2016 | Peyton | |
| 9,326,564 | B2 | 5/2016 | Peyton | |
| 9,420,848 | B2 | 8/2016 | Campos | |
| 9,445,646 | B2 | 9/2016 | Cook | |
| 9,456,658 | B2 | 10/2016 | Bruce | |
| 9,486,037 | B2 | 11/2016 | Cook | |
| 9,516,919 | B2 | 12/2016 | Ernst | |
| 9,521,877 | B2 | 12/2016 | Campos, II | |
| 9,629,414 | B2 | 4/2017 | Elder | |
| 9,750,307 | B2 | 9/2017 | Campos, II | |
| 9,801,428 | B2 | 10/2017 | Taylor | |
| 9,894,959 | B2 | 2/2018 | Taylor | |
| 9,907,357 | B2 | 3/2018 | Youngs | |
| 9,913,511 | B2 | 3/2018 | Peyton | |
| 9,981,437 | B2 | 5/2018 | Campos, II | |
| 9,987,814 | B2 | 6/2018 | Campos, II | |
| 10,010,136 | B2 | 7/2018 | Shaffer | |
| 10,098,410 | B2 | 10/2018 | Cook | |
| 10,111,492 | B2 | 10/2018 | Foxen | |
| 10,178,891 | B2 | 1/2019 | Christensen | |
| 10,244,821 | B2 | 4/2019 | Elder | |
| 10,271,613 | B2 | 4/2019 | Campos | |
| 10,299,536 | B2 | 5/2019 | Ernst | |
| 10,327,507 | B2 | 6/2019 | Taylor | |
| 10,441,029 | B2 | 10/2019 | Campos, II | |
| 10,477,919 | B2 | 11/2019 | Taylor | |
| 10,624,417 | B2 | 4/2020 | Dojan | |
| 10,675,828 | B2 | 6/2020 | Campos, II | |
| 10,702,016 | B2 | 7/2020 | Youngs | |
| 10,729,206 | B2 | 8/2020 | Campos, II | |
| 10,743,609 | B2 | 8/2020 | Meschter | |
| 10,758,011 | B2 * | 9/2020 | Bock | A43B 3/34 |
| 10,849,387 | B2 | 12/2020 | Bruce | |
| 10,856,612 | B2 | 12/2020 | Heard | |
| 10,897,958 | B2 | 1/2021 | Peyton | |
| 10,939,726 | B2 | 3/2021 | Scofield | |
| 11,033,079 | B2 * | 6/2021 | Bock | A43C 1/00 |
| 2004/0049946 | A1 * | 3/2004 | Lucas | A43B 1/0009 36/28 |
| 2006/0117599 | A1 * | 6/2006 | Deem | A43B 7/08 36/3 B |
| 2006/0248750 | A1 | 11/2006 | Rosenberg | |
| 2009/0013558 | A1 * | 1/2009 | Hazenberg | B29C 65/02 521/50 |
| 2010/0005684 | A1 * | 1/2010 | Nishiwaki | A43B 13/20 36/28 |
| 2011/0185590 | A1 * | 8/2011 | Nishiwaki | A43B 13/187 36/28 |
| 2018/0263336 | A1 | 9/2018 | Dekovic | |
| 2019/0037964 | A1 | 2/2019 | Foxen | |
| 2019/0126580 | A1 * | 5/2019 | Paulson | B29C 33/0061 |
| 2019/0142103 | A1 | 5/2019 | Christensen | |
| 2019/0246738 | A1 | 8/2019 | Connell | |
| 2019/0261739 | A1 | 8/2019 | Taylor | |
| 2019/0380435 | A1 | 12/2019 | Campos | |
| 2020/0085140 | A1 * | 3/2020 | Hurd | B29D 35/142 |
| 2020/0196704 | A1 | 6/2020 | Dojan | |
| 2020/0205514 | A1 | 7/2020 | VanDomelen | |
| 2020/0260820 | A1 | 8/2020 | Youngs | |
| 2020/0262167 | A1 | 8/2020 | Campos, II | |
| 2020/0315291 | A1 | 10/2020 | Tucker | |
| 2020/0375308 | A1 | 12/2020 | Langvin | |
| 2021/0052034 | A1 * | 2/2021 | Cass | A43B 13/125 |
| 2021/0052037 | A1 | 2/2021 | Greenspan | |

FOREIGN PATENT DOCUMENTS

| | | | | |
|---|---|---|---|---|
| EP | 2074901 | A1 | 7/2009 | |
| EP | 1753314 | B1 | 1/2011 | |
| EP | 2197309 | B1 | 11/2012 | |
| EP | 2319343 | B1 | 5/2013 | |
| EP | 2609824 | A1 | 7/2013 | |
| EP | 2369952 | B1 | 12/2013 | |
| EP | 2332432 | A4 | 1/2014 | |
| EP | 2568841 | B1 | 7/2014 | |
| EP | 2559351 | B1 | 1/2015 | |
| EP | 2227107 | B1 | 4/2015 | |
| EP | 2298109 | B1 | 7/2015 | |
| EP | 2197307 | B1 | 8/2015 | |
| EP | 2227106 | B1 | 2/2016 | |
| EP | 2506735 | B1 | 7/2016 | |
| EP | 2897483 | B1 | 12/2016 | |
| EP | 2937008 | B1 | 7/2017 | |
| EP | 2793630 | B1 | 8/2017 | |
| EP | 2897484 | B1 | 8/2017 | |
| EP | 2227108 | B1 | 11/2017 | |
| EP | 2910140 | B1 | 12/2017 | |
| EP | 2979566 | B1 | 12/2017 | |
| EP | 2229067 | B1 | 2/2018 | |
| EP | 2929791 | B1 | 3/2018 | |
| EP | 3338582 | A1 | 6/2018 | |
| EP | 2897482 | B1 | 10/2018 | |
| EP | 2764787 | B1 | 11/2018 | |
| EP | 3243400 | B1 | 3/2019 | |
| EP | 3185712 | B1 | 6/2019 | |
| EP | 3692852 | A1 | 8/2020 | |
| EP | 3692854 | A1 | 8/2020 | |
| EP | 3721739 | A1 | 10/2020 | |
| EP | 3429391 | B1 | 11/2020 | |
| EP | 3095344 | B1 | 12/2020 | |
| EP | 3250073 | B1 | 12/2020 | |
| EP | 3597067 | B1 | 2/2021 | |
| EP | 3785562 | A1 | 3/2021 | |
| WO | 2015175605 | A1 | 11/2015 | |
| WO | 2017053692 | A1 | 3/2017 | |
| WO | 2017160730 | A1 | 9/2017 | |
| WO | 2019157244 | A1 | 8/2019 | |
| WO | 2020099439 | A1 | 5/2020 | |
| WO | 2020142429 | A1 | 7/2020 | |
| WO | 2020206240 | A1 | 10/2020 | |
| WO | 2020243385 | A1 | 12/2020 | |
| WO | 2021041269 | A1 | 3/2021 | |
| WO | WO-2023067439 | A1 * | 4/2023 | A43B 13/122 |

* cited by examiner

FIG. 8
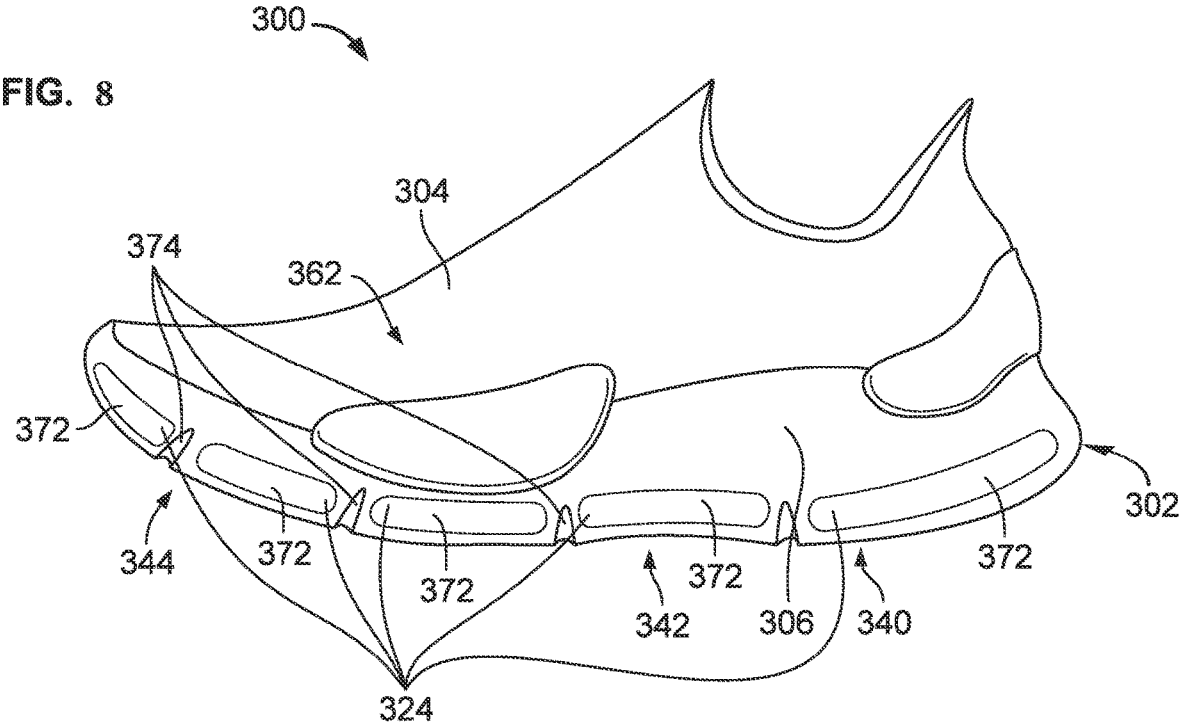
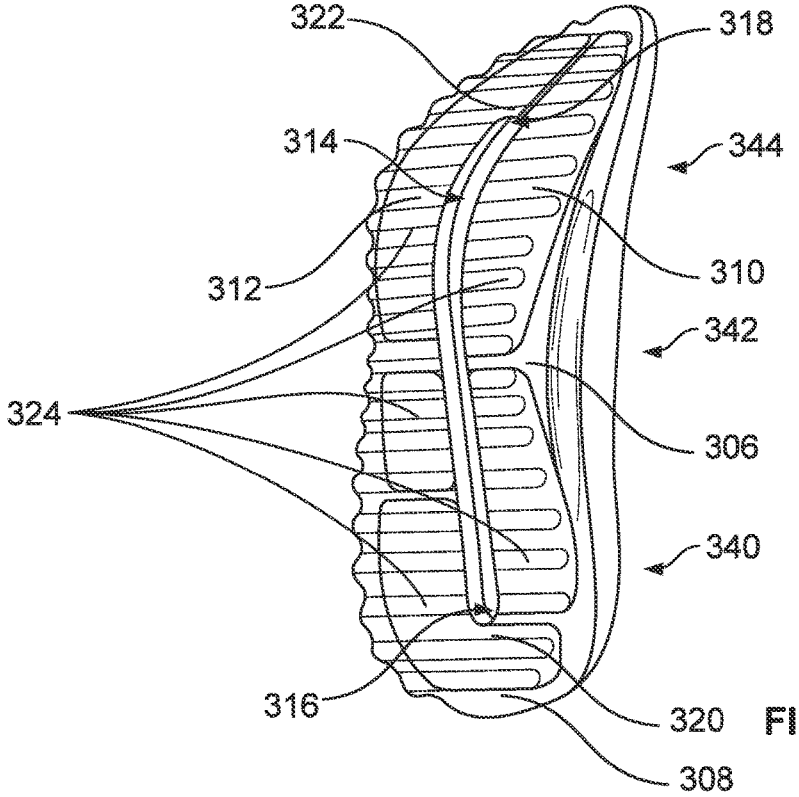
FIG. 9

SHOE WITH FOAM PODS AND CHASSIS

CROSS REFERENCE TO RELATED APPLICATIONS

This application claims the benefit of and priority to U.S. Provisional App. No. 63/256,874, filed on Oct. 18, 2021, entitled "SHOE WITH FOAM PODS AND CHASSIS", which is herein incorporated by reference in its entirety.

BACKGROUND

1. Field of the Disclosure

The present disclosure relates generally to an article of footwear.

2. Description of the Background

Many conventional shoes or other articles of footwear generally comprise an upper and a sole attached to a lower end of the upper. Conventional shoes further include an internal space, i.e., a void or cavity, which is created by interior surfaces of the upper and sole, that receives a foot of a user before securing the shoe to the foot. The sole is attached to a lower surface or boundary of the upper and is positioned between the upper and the ground. As a result, the sole typically provides stability and cushioning to the user when the shoe is being worn. In some instances, the sole may include multiple components, such as an outsole, a midsole, and an insole. The outsole may provide traction to a bottom surface of the sole, and the midsole may be attached to an inner surface of the outsole, and may provide cushioning or added stability to the sole. For example, a sole may include a particular foam material that may increase stability at one or more desired locations along the sole, or a foam material that may reduce stress or impact energy on the foot or leg when a user is running, walking, or engaged in another activity. The sole may also include additional components, such as plates, embedded with the sole to increase the overall stiffness of the sole and reduce energy loss during use.

The upper generally extends upward from the sole and defines an interior cavity that completely or partially encases a foot. In most cases, the upper extends over the instep and toe regions of the foot, and across medial and lateral sides thereof. Many articles of footwear may also include a tongue that extends across the instep region to bridge a gap between edges of medial and lateral sides of the upper, which define an opening into the cavity. The tongue may also be disposed below a lacing system and between medial and lateral sides of the upper, to allow for adjustment of shoe tightness. The tongue may further be manipulable by a user to permit entry or exit of a foot from the internal space or cavity. In addition, the lacing system may allow a user to adjust certain dimensions of the upper or the sole, thereby allowing the upper to accommodate a wide variety of foot types having varying sizes and shapes.

The upper may comprise a wide variety of materials, which may be chosen based on one or more intended uses of the shoe. The upper may also include portions comprising varying materials specific to a particular area of the upper. For example, added stability may be desirable at a front of the upper or adjacent a heel region so as to provide a higher degree of resistance or rigidity. In contrast, other portions of a shoe may include a soft woven textile to provide an area with stretch-resistance, flexibility, air-permeability, or moisture-wicking properties.

However, while many currently-available shoes have varying features related to the above-noted properties, many shoes, and the sole structures thereof, may be further optimized to provide targeted support to a user's foot to aid in stability while running, walking, or engaging in strenuous athletic activities. Additionally, many shoes, and their sole structures, may be further optimized to provide targeted support to a user's foot to reduce energy dissipation and thereby increase the efficiency of a user during physical activity, such as running. Moreover, many shoes, and their sole structures, may be further optimized to provide additional support and cushioning to a user's bones and tissue in the user's foot. Still further, many shoes, and their sole structures, may be optimized to provide protection for a user's tissue, bones, and ligaments from excessive loads.

Therefore, articles of footwear having features providing such effects across areas of the foot are desired. These and other deficiencies with the prior art are outlined in the following disclosure.

SUMMARY

An article of footwear, as described herein, may have various configurations. The article of footwear may have an upper and a sole structure that is coupled with the upper. The sole structure may define a forefoot region, a midfoot region, and a heel region. The sole structure may include a plurality of pods. Each pod may have a pod body and may also optionally have a coating that is disposed on an outer surface of the pod body. The sole structure may also include a chassis that is attached to a bottom surface of each pod in the plurality of pods. The pod body of each pod in the plurality of pods may be formed from a foam material. The chassis may include a plurality of ground contacting regions. The chassis may have an elongated fork structure. The elongated fork includes a chassis stem, a first chassis leg that extends from the chassis stem through the heel region, the midfoot region, and the forefoot region of the sole structure, and a second chassis leg that also extends from the chassis stem through the heel region, the midfoot region, and the forefoot region. The elongated fork structure also has a continuous elongated groove that is positioned between the first chassis leg and the second chassis leg. The continuous elongated groove extends along substantially the entire length of the first chassis leg and the second chassis leg.

The article of footwear, as described herein, may have an upper and a sole structure that is coupled with the upper. The sole structure may define a forefoot region, a midfoot region, and a heel region. The sole structure may include a plurality of pods. Each pod may have a pod body and may also optionally have a coating that is disposed on an outer surface of the pod body. The sole structure may also include a chassis that is attached to a bottom surface of each pod in the plurality of pods. The pod body of each pod in the plurality of pods is formed from a foam material. The foam material in the pod body of at least one pod in the plurality of pods may have a density that is different than the density of the foam material in the pod body of at least one other pod in the plurality of pods. The chassis may include a plurality of ground contacting regions. The chassis may not be attached to the upper.

In another embodiment, the article of footwear may have an upper and a sole structure that is coupled with the upper. The sole structure may define a forefoot region, a midfoot region, and a heel region. The sole structure may include a plurality of pods. Each pod may have a pod body and may also optionally have a coating that is disposed on an outer surface of the pod body. The sole structure may also include a chassis that is attached to a bottom surface of each pod in the plurality of pods. The pod body of each pod in the plurality of pods is formed from a foam material. The foam material in the pod body of at least one pod in the plurality of pods may have a density that is different than the density of the foam material in the pod body of at least one other pod in the plurality of pods. The chassis may encapsulate each pod in the plurality of pods.

Other aspects of the articles of footwear described herein, including features and advantages thereof, will become apparent to one of ordinary skill in the art upon examination of the figures and detailed description herein. Therefore, all such aspects of the articles of footwear are intended to be included in the detailed description and this summary.

BRIEF DESCRIPTION OF THE DRAWINGS

FIG. 8 is a lateral side view of the shoe of another article of footwear configured as a left shoe that includes an upper and a sole structure, as discussed herein;

FIG. 9 is a is a bottom perspective view of a portion of a chassis, according to an embodiment of the present disclosure;

DETAILED DESCRIPTION OF THE DRAWINGS

The following discussion and accompanying figures disclose various embodiments or configurations of a shoe having an upper and a sole structure. Although embodiments are disclosed with reference to a sports shoe, such as a running shoe, tennis shoe, basketball shoe, etc., concepts associated with embodiments of the shoe may be applied to a wide range of footwear and footwear styles, including cross-training shoes, football shoes, golf shoes, hiking shoes, hiking boots, ski and snowboard boots, soccer shoes and cleats, walking shoes, and track cleats, for example. Concepts of the shoe may also be applied to articles of footwear that are considered non-athletic, including dress shoes, sandals, loafers, slippers, and heels.

The term "about," as used herein, refers to variations in the numerical quantity that may occur, for example, through typical measuring and manufacturing procedures used for articles of footwear or other articles of manufacture that may include embodiments of the disclosure herein; through inadvertent error in these procedures; through differences in the manufacture, source, or purity of the ingredients used to make the compositions or mixtures or carry out the methods; and the like. Throughout the disclosure, the terms "about" and "approximately" refer to a range of values±5% of the numeric value that the term precedes.

The present disclosure is directed to an article of footwear or specific components of the article of footwear, such as an upper or a sole or a sole structure. The sole structure defines a forefoot region, a midfoot region, and a heel region. The sole structure is coupled with the upper. The sole structure includes a plurality of pods and a chassis. The plurality of pods are connected to the upper. More specifically, the top surface of each pod is connected to the bottom surface of the upper. The chassis is connected to the plurality of pods. More specifically, the bottom surface of each pod is connected to at least the top surface of the chassis. In an embodiment, the chassis is not connected directly to the upper.

While only a single shoe is depicted, i.e., a shoe that is worn on a left foot of a user, it should be appreciated that the concepts disclosed herein are applicable to a pair of shoes (not shown), which includes a left shoe and a right shoe that may be sized and shaped to receive a left foot and a right foot of a user, respectively. For ease of disclosure, however, a single shoe will be referenced to describe aspects of the disclosure, but the disclosure below with reference to the article of footwear is applicable to both a left shoe and a right shoe. However, in some embodiments there may be differences between a left shoe and a right shoe other than the left/right configuration. Further, a left shoe may include one or more additional elements that a right shoe does not include, or vice versa.

Figure 1:
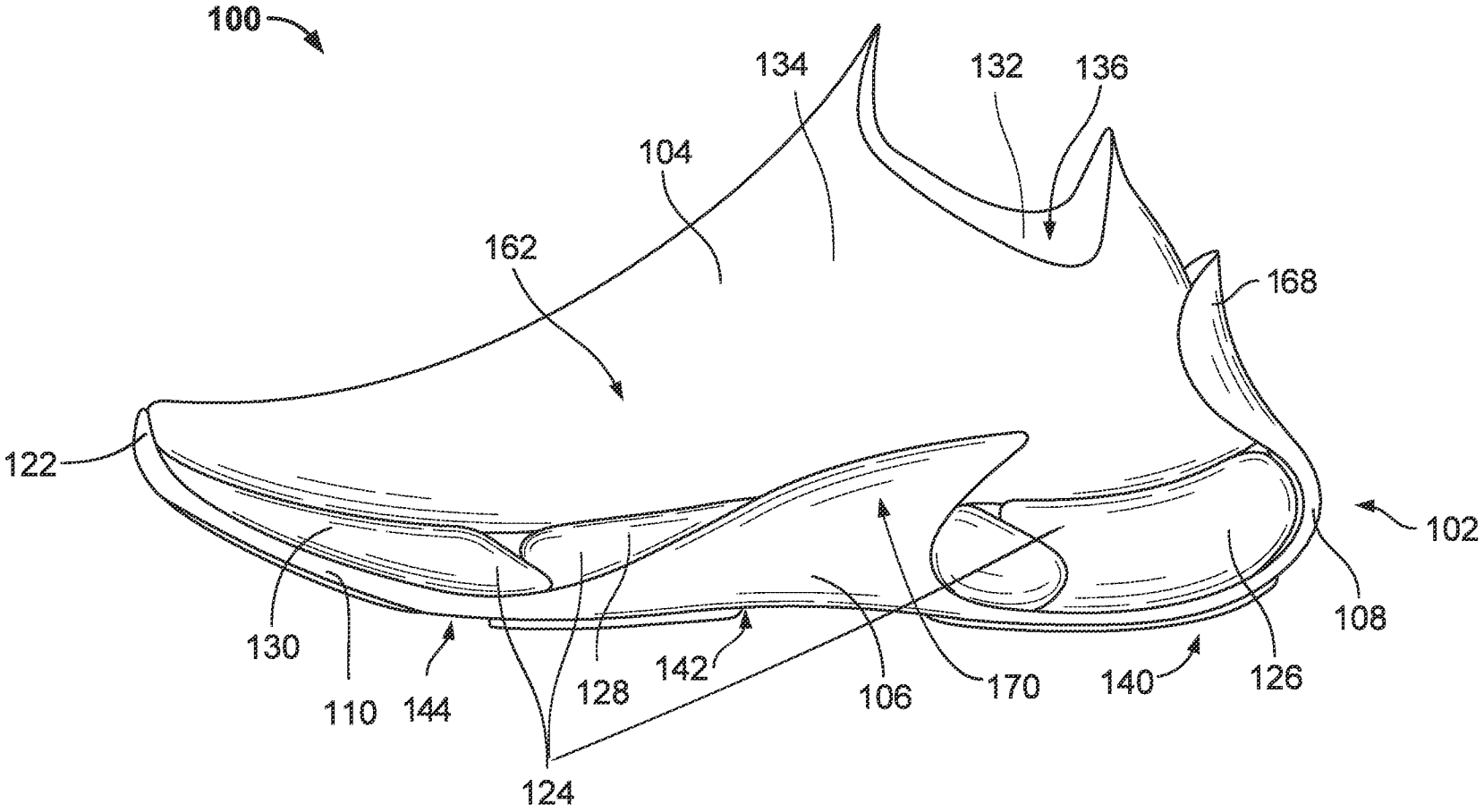
FIG. 1 a lateral side view of an article of footwear configured as a left shoe that includes an upper and a sole structure, as discussed herein.
Figure 2:
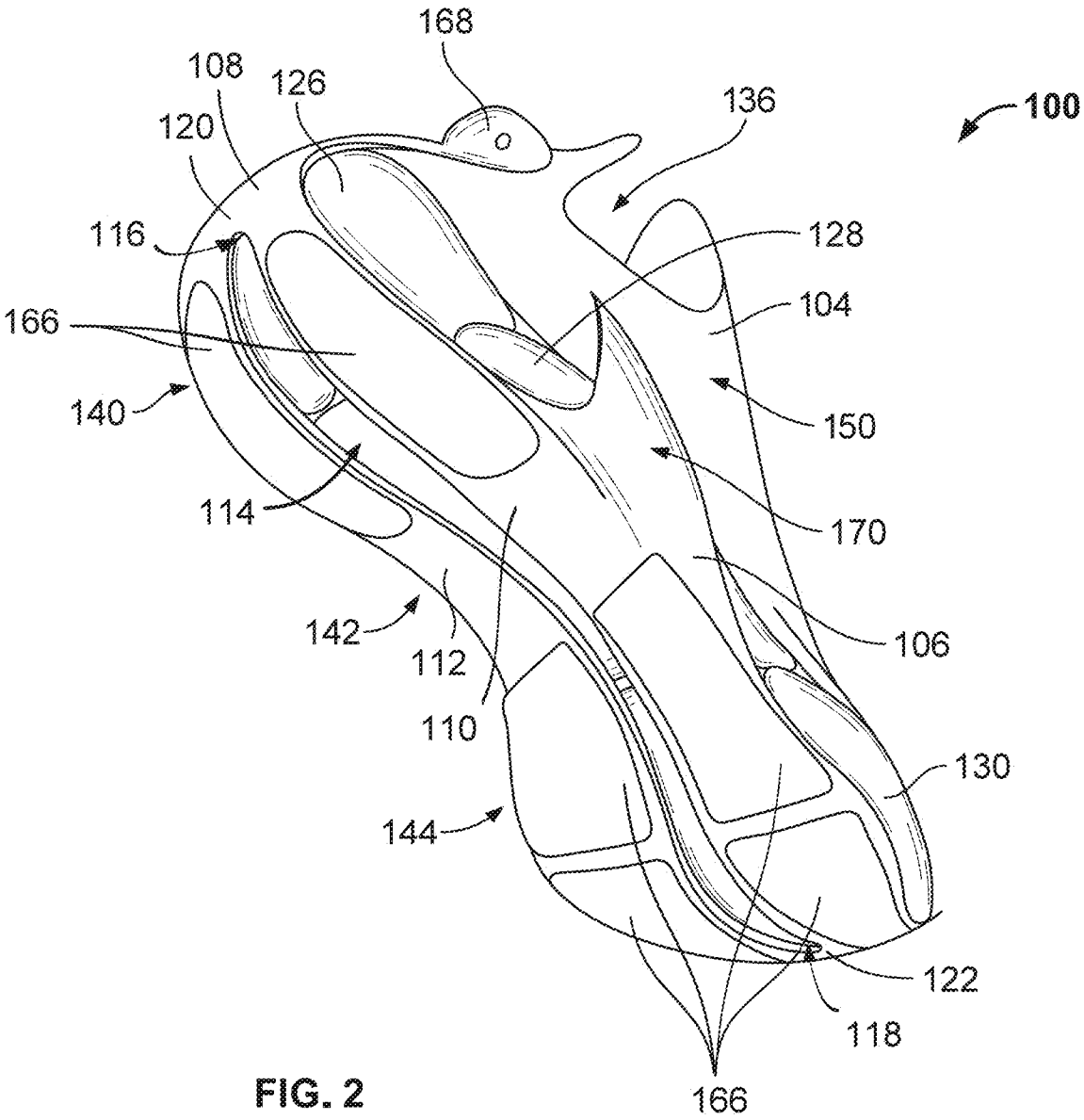
FIG. 2 is a bottom perspective view of the shoe of FIG. 1.

Referring initially to FIGS. 1 and 2, the article of footwear 100 comprises sole structure 102 and an upper 104. The upper 104 will be discussed in more detail below. The sole structure 102 is coupled with the upper 104. The sole structure 102 includes a chassis 106 having a chassis stem 108, a first chassis leg 110, a second chassis leg 112 (shown in FIG. 2), and a continuous elongated groove 114. The continuous elongated groove 114 has a first end 116, a second end 118, a heel joint 120, and a toe joint 122. The sole structure 102 also includes a plurality of pods 124. The plurality of pods 124 includes a first pod 126, a second pod 128, and third pod 130. The chassis 106 is coupled with the plurality of pods 124. The plurality of pods 124 is connected directly with the upper 104. The chassis 106 may be connected directly to the upper 104. However, in some embodiments, it is preferred that the chassis 106 is not connected directly to the upper 104, but rather the chassis 106 is only indirectly coupled with the upper 104 by way of attachment between the chassis 106 and the plurality of pods 124 and further attachment between the plurality of pods 124 and the upper 104. When fully assembled, the upper 104 includes an interior surface 132, an exterior surface 134, and an interior cavity 136. The interior surface 132 faces inward and generally defines the interior cavity 136, and the exterior surface 134 of the upper 104 faces outward and generally defines an outer perimeter or boundary of the upper 104. As will be discussed in greater detail below, the pods in the plurality of pods 124 may be customized so that a given plurality of pods 124 may have specific properties that are tailored to meet the needs of a given user.

Figure 3:
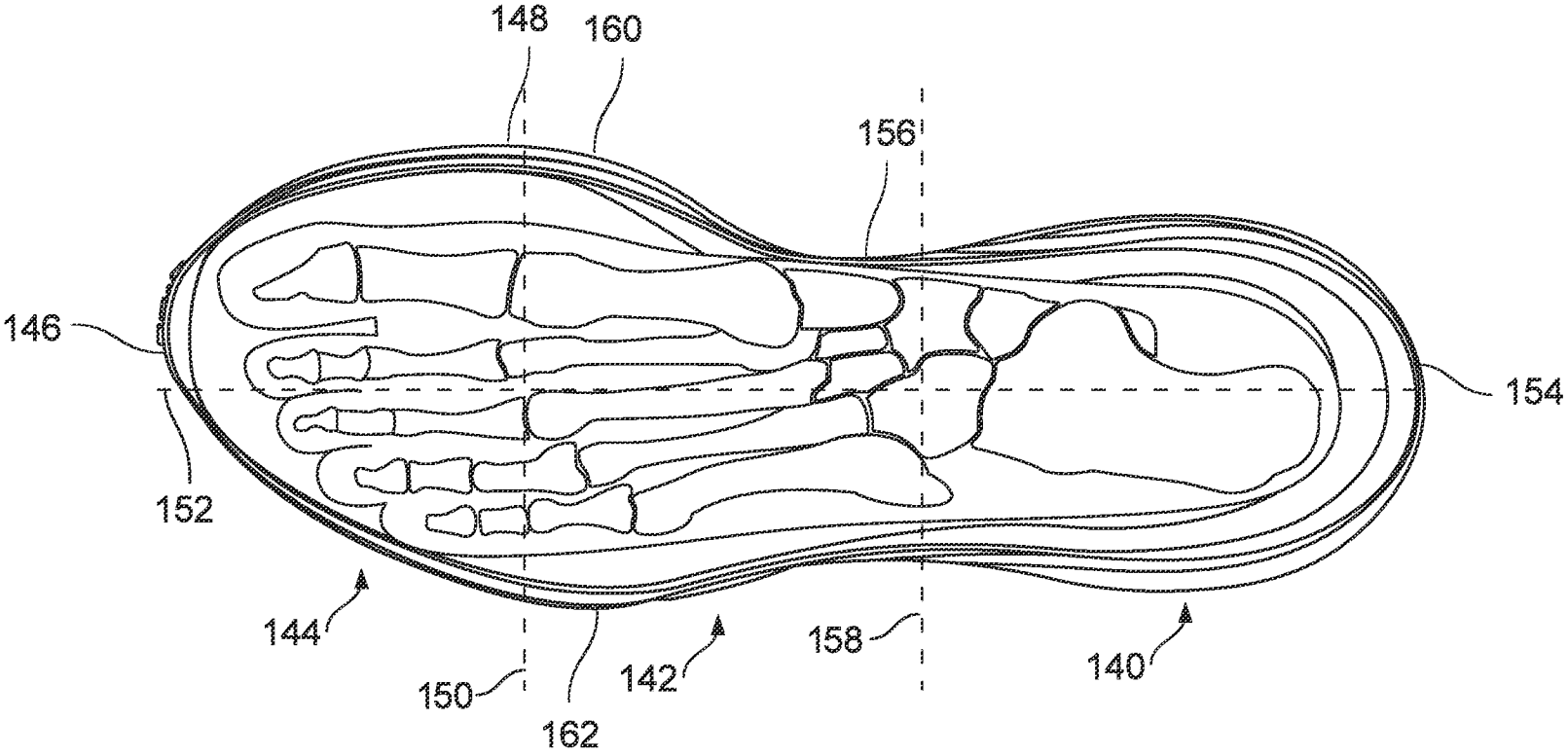
FIG. 3 is a top plan view of the shoe of FIG. 1, with the upper removed and a user's skeletal foot structure overlaid thereon.

Referring now to FIG. 3, the article of footwear 100 has a heel region 140, a midfoot region 142, and a forefoot region 144. The forefoot region 144 generally corresponds with portions of the article of footwear 100 that encase portions of the foot that includes the toes, the ball of the foot, and joints connecting the metatarsals with the toes or phalanges. The midfoot region 142 is proximate and adjoining the forefoot region 144, and generally corresponds with portions of the article of footwear 100 that encase the arch of the foot, along with the bridge of a foot. The heel region 140 is proximate and adjoining the midfoot region 142 and generally corresponds with portions of the article of footwear 100 that encase rear portions of the foot, including the heel or calcaneus bone, the ankle, or the Achilles tendon.

The forefoot region 144 extends from a toe end 146 to a widest portion 148 of the article of footwear 100. The widest portion 148 is defined or measured along a first line 150 that is perpendicular with respect to a longitudinal axis 152 that extends from a distal portion of the toe end to a distal portion of a heel end 154, which is opposite the toe end. The midfoot region 142 extends from the widest portion 148 to a thinnest portion 156 of the article of footwear 100. The thinnest portion 156 of the article of footwear 100 is defined as the portion of the article of footwear 100 having the least width, as measured along a second line 158 that is perpendicular with respect to the longitudinal axis 152. The heel region 140 extends from the thinnest portion 156 to the heel end 154 of the article of footwear 100.

The heel region 140, the midfoot region 142, the forefoot region 144, a medial side 160, and a lateral side 162 define boundaries or areas of the article of footwear 100, and generally characterize sections of the article of footwear 100. Certain aspects of the disclosure may refer to portions or elements that are coextensive with one or more of the heel region 140, the midfoot region 142, the forefoot region 144, the medial side 160, or the lateral side 162. Further, both the upper 104 and the sole structure 102 may be characterized as having portions within the heel region 140, the midfoot region 142, the forefoot region 144, or along the medial side 160 or the lateral side 162. Therefore, the upper 104 and the sole structure 102, or individual portions of the upper 104 and the sole structure 102, may include portions thereof that are disposed within the heel region 140, the midfoot region 142, the forefoot region 144, or along the medial side 160 or the lateral side 162.

When a user is wearing the article of footwear 100 (configured as a pair of shoes), the lateral side 162 corresponds with an outside-facing portion of the article of footwear 100 while the medial side 160 corresponds with an inside-facing portion of the article of footwear 100. As such, a left shoe and a right shoe have opposing lateral sides 162 and medial sides 160, such that the medial sides 160 are closest to one another when a user is wearing the shoes, while the lateral sides 162 are the sides that are farthest from one another. As will be discussed in greater detail below, the medial side 160 and the lateral side 162 adjoin one another along a longitudinal central plane or axis 152 at opposing, distal ends of the article of footwear 100. As will also be further discussed herein, the longitudinal central plane or axis 152 may demarcate a central, intermediate axis between the medial side 160 and the lateral side 162 of the article of footwear 100. Put differently, the longitudinal plane or axis 152 may extend between a toe end 146 of the article of footwear 100 and a heel end 154 of the article of footwear 100. The longitudinal axis 152 may continuously define a middle of the sole structure 102, or the upper 104 of the article of footwear 100, i.e., the longitudinal plane or axis 152 may be a straight axis extending from the heel end 154 of the heel region 140 to the toe end 146 of the forefoot region 144.

Still referring to FIG. 3, the medial side 160 begins at the toe end 146 and bows outward along the forefoot region 144 toward the midfoot region 142. At the first line 150, the medial side 160 bows inward, toward the central, longitudinal axis 152. The medial side 160 extends from the first line 150, i.e., the widest portion 148, toward the second line 158, i.e., the thinnest portion 156, entering into the midfoot region 142 upon crossing the first line 150. After reaching the second line 158, the medial side 160 bows outward, away from the longitudinal, central axis 152, at which point the medial side 160 extends into the heel region 140, i.e., upon crossing the second line 158. The medial side 160 then bows outward and then inward toward the heel end 154, and terminates at a point where the medial side 160 meets the longitudinal, center axis 152.

The lateral side 162 also begins at the toe end 146 and bows outward along the forefoot region 144 toward the midfoot region 142. The lateral side 162 reaches the first line 150, at which point the lateral side 162 bows inward, toward the longitudinal, central axis 152. The lateral side 162 extends from the first line 150, i.e., the widest portion 148, toward the second line 158, i.e., the thinnest portion 156, entering into the midfoot region 142 upon crossing the first line 150. After reaching the second line 158, the lateral side 162 bows outward, away from the longitudinal, central axis 152, at which point the lateral side 162 extends into the heel region 140, i.e., upon crossing the second line 158. The lateral side 162 then bows outward and then inward toward the heel end 154, and terminates at a point where the lateral side 162 meets the longitudinal, center axis 152.

It should be understood that numerous modifications may be apparent to those skilled in the art in view of the foregoing description, and individual components thereof, may be incorporated into numerous articles of footwear. Accordingly, aspects of the article of footwear 100 and components thereof, may be described with reference to general areas or portions of the article of footwear 100, with an understanding the boundaries of the heel region 140, the midfoot region 142, the forefoot region 144, the medial side 160, or the lateral side 162 as described herein may vary between articles of footwear. However, aspects of the article of footwear 100 and individual components thereof, may also be described with reference to exact areas or portions of the article of footwear 100 and the scope of the appended claims herein may incorporate the limitations associated with these boundaries of the heel region 140, the midfoot region 142, the forefoot region 144, the medial side 160, or the lateral side 162 discussed herein.

Referring again to FIGS. 1 and 2, the sole structure 102 includes a chassis 106 that is attached to a bottom surface of each pod of the plurality of pods 124. As best shown in FIG. 2, the chassis 106 is configured in an elongated fork structure. The elongated fork structure of the chassis 106 includes the chassis stem 108, the first chassis leg 110, and the second chassis leg 112. The chassis stem 108 is positioned in the heel region 140 of the sole structure 102 and includes a heel joint 120 that connects the first chassis leg 110 and the second chassis leg 112. The chassis stem 108 may be integral with the first chassis leg 110 and the second chassis leg 112. The chassis stem 108 extends upwardly (i.e. away from the ground) from the heel joint 120. In a particular embodiment, the chassis stem 108 extends upwardly, around at least a portion of a pod 124 that is disposed in the heel region 140. A portion of the chassis stem 108 may be connected to at least one pod 124. In other embodiments, the entirety of the chassis stem 108 may be connected to one or more pods 124.

The elongated fork structure of the chassis 106 includes the first chassis leg 110. The first chassis leg 110 extends from the chassis stem 108. The first chassis leg 110 extends along the bottom surface of the plurality pods 124, and through the heel region 140, the midfoot region 142, and the forefoot region 144 of the sole structure 102. The first chassis leg 110 defines at least a portion of the bottom-most surface of the article of footwear 100, and may define at least a portion of the bottom-most surface of the article of footwear 100 in each of the heel region 140, the midfoot region 142, and the forefoot region 144. In some embodiments, the first chassis leg 110 may be integral with the chassis stem 108. Alternatively, the first chassis leg 110 may be formed separately from and coupled to the chassis stem 108, in any suitable manner. The first chassis leg 110 may be disposed substantially on a medial portion of the sole structure 102. Alternatively, the first chassis leg 110 may be disposed substantially on a lateral portion of the sole structure 102.

The elongated fork structure of the chassis 106 also includes the second chassis leg 112. The second chassis leg 112 may be substantially similar to the first chassis leg 110. The second chassis leg 112 extends from the chassis stem 108. The second chassis leg 112 is positioned opposite the first chassis leg 110, such that if the first chassis leg 110 is disposed substantially on a medial portion of the bottom surface of the sole structure 102, then the second chassis leg 112 is disposed substantially on a lateral portion of the sole structure 102. In certain embodiments, the inverse arrangement of the first chassis leg 110 and the second chassis leg 112 is possible. Like the first chassis leg 110, the second chassis leg 112 extends from the chassis stem 108 and through the heel region 140, the midfoot region 142, and the forefoot region 144 of the sole structure 102. The second chassis leg 112 defines at least a portion of the bottom-most surface of the article of footwear 100, and may define at least a portion of the bottom-most surface of the article of footwear 100 in each of the heel region 140, the midfoot region 142, and the forefoot region 144 of the sole structure. The second chassis leg 112 may be integral with the chassis stem 108. In a particular embodiment, the entire chassis 106 (including at least the stem 108, first leg 110, and the second leg 112) may be formed as a single unitary piece that is integrally formed from a single material. Alternatively, the second chassis leg 112 may be formed separately and coupled to the chassis stem 108, in any suitable manner.

The chassis 106 may include the toe joint 122. In embodiments that include the toe joint 122, the toe joint 122 is positioned between the first chassis leg 110 and the second chassis leg 112 in the forefoot region 144 of the sole structure 102. The toe joint 122 may be substantially similar to the portion of the chassis stem 108 that forms the heel joint 120 between the first chassis leg 110 and the second chassis leg 112 in the heel region 140 of the sole structure 102. Alternatively, no toe joint 122 may be provided. In this instance, the first chassis leg 110 and the second chassis leg 112 remain distanced from each other throughout the entirety of the midfoot region 142 and the forefoot region 144.

The elongated fork structure of the chassis 106 also includes the continuous elongated groove 114. The continuous elongated groove 114 is positioned between the first chassis leg 110 and the second chassis leg 112. The continuous elongated groove 114 has a first end 116 that is located in the heel region 140, adjacent to the portion of the chassis stem 108 that forms the heel joint 120. The continuous elongated groove 114 extends along substantially the entire length of the first chassis leg 110 and the second chassis leg 112. The continuous elongated groove 114 separates substantially all of the length of the first chassis leg 110 from substantially all of the length of the second chassis leg 112. The continuous elongated groove 114 may have second end 118 that is located in the forefoot region 144 of the sole structure 102, adjacent to the toe joint 122.

The second end 118 of the continuous elongated groove 114 may be adjacent to the toe joint 122, when provided, such that the continuous elongated groove 114 is fully enclosed within and surrounded by the chassis 106 (in the longitudinal direction), as measured along the central, longitudinal axis 152. Alternatively, the second end 118 of the continuous elongated groove 114 may be open/exposed in the forefoot region 144, such that the chassis 106 does not fully enclose the length of the continuous elongated groove 114. In one embodiment, the width of the continuous elongated groove 114 tapers proximate both the first end 116 and the second end 118. In other embodiments, the width of the elongated groove 114 tapers at the first end 116 (in the heel region 140) but remains substantially uniform at the second end 118 (in the forefoot region 144). Alternatively, the width of the elongated groove 114 may remain substantially uniform at both the first end 116 and the second end 118. Additionally, the continuous elongated groove 114 may be wider in the midfoot region 142 and/or forefoot region 144 than in the heel region 140.

The continuous elongated groove 114 may be configured as an opening that can extend through the entire thickness of the chassis 106. Alternatively, the continuous elongated groove 114 may be configured as an area that does not extend through the entire thickness of the chassis 106, but instead forms a portion of the chassis 106 having a reduced thickness. The thickness of the chassis 106 may be reduced by any suitable amount, throughout the elongated groove 114. For example, the thickness of the chassis 106 may be reduced by at least 50%, or at least 60%, or at least 70%, or at least 90%, or at least 95%, throughout the elongated groove 114. In an embodiment, at least a portion of one or more of the pods may be visible through a portion of the continuous elongated groove 114.

Still referring to FIGS. 1 and 2, the chassis 106 may also include additional optional components, such as a plurality of ground contacting regions 166 (which themselves may include traction pads), a heel support plate 168, and/or a support fin 170.

When present, the ground contacting regions 166 are disposed on portions of the bottom surface of the chassis 106. Put another way, when an article of footwear 100 is worn by a user, portions of the bottom surface of the chassis 106 (i.e. ground contact regions 166) directly interface with the ground on which the user walks or stands. The first chassis leg 110 and/or the second chassis leg 112 may comprise a plurality of ground contacting regions 166. Specifically, both the first chassis leg 110 and the second chassis leg 112 may each comprise a plurality of ground contacting regions 166. The chassis 106 may also comprise one or more traction pads. The traction pads may be positioned in some or all of the ground contacting regions 166. The traction pads may be integrally formed with the chassis 106. Alternatively, the traction pads may be coupled to the chassis 106 in any suitable manner. The ground contacting portions 166 of the traction pads, i.e. the bottom surface of the traction pads, may include "high abrasion" textures or other features that are suitable for improving grip between the article of footwear 100 and the ground. The chassis 106 may be formed from one or more materials to impart durability, wear-resistance, abrasion resistance, or traction to the sole structure. For example, the chassis may be formed from rubber.

Still referring to FIGS. 1 and 2, the chassis 106 may also include additional optional components, such as a plurality of ground contacting regions 166 (which themselves may include traction pads), a heel support plate 168, and/or a support fin 170.

When present, the heel support plate 168 that extends upwardly, i.e., away from the ground, from the chassis stem 108. The heel support plate 168 may extend along and around at least a portion of at least one pod 124. The heel support plate 168 may extend along at least some of the upper 104 in the heel region 140. The heel support plate 168 may be attached to a portion of at least one pod 124. Additionally, the heel support plate 168 may be distanced from, and therefore not attached directly to, the upper 104. Beneficially, this may allow a heel portion of the upper 104 to have some space in which to expand, potentially to accommodate different foot sizes of different users, while simultaneously providing a region of rigidity and support to a heel portion of the upper 104. The heel support plate 168 may further have a flange extending from the upper-most edge of the heel support plate 168. The heel support plate 168 may have any suitable shape. The heel support plate 168 may have a substantially ovular or a substantially rectangular shape. The heel support plate 168 may be formed from any suitable material. For example, the heel support plate 168 may be formed from the same material as the chassis 106. In a particular embodiment, the heel support plate 168 may be integral with the chassis 106. Alternatively, the heel support plate 168 may be formed separately from and then subsequently attached to the chassis 106.

When present, the support fin 170 extend upwardly from the first chassis leg 110 in the midfoot region 142 of the sole structure 102. The support fin 170 may be positioned on lateral side 162 of the article of footwear 100. Alternatively, the support fin 170 may be positioned on medial side 160 of the article of footwear 100. Some articles of footwear may have multiple support fins 170, such that a support fin 170 may be positioned on both the lateral side 162 and the medial side 160 of the article of footwear 100. The support fin 170 may have any suitable shape. In a particular embodiment, the support fin 170 may have a substantially triangular shape. Alternatively, support fin 170 may have a shape that is commonly associated with the dorsal appendage of a dolphin or shark, i.e., a fin. The support fin 170 may be made from any suitable material. In an embodiment, the support fin 170 may be made from the same material as the chassis 106. The support fin 170 may be integral with the chassis 106. Alternatively, the support fin 170 may be formed separately from and subsequently attached to the chassis 106. In certain embodiments, the support fin 170 may be attached to at least a portion of one or more pods 124. Additionally, the support fin 170 may be distanced from, and therefore not attached directly to, the side of the upper 104. Beneficially, this may allow the upper 104 to have space in which to expand, potentially to accommodate different foot sizes of different users, while simultaneously providing a region of rigidity and support to a side of the upper 104.

Figure 4:
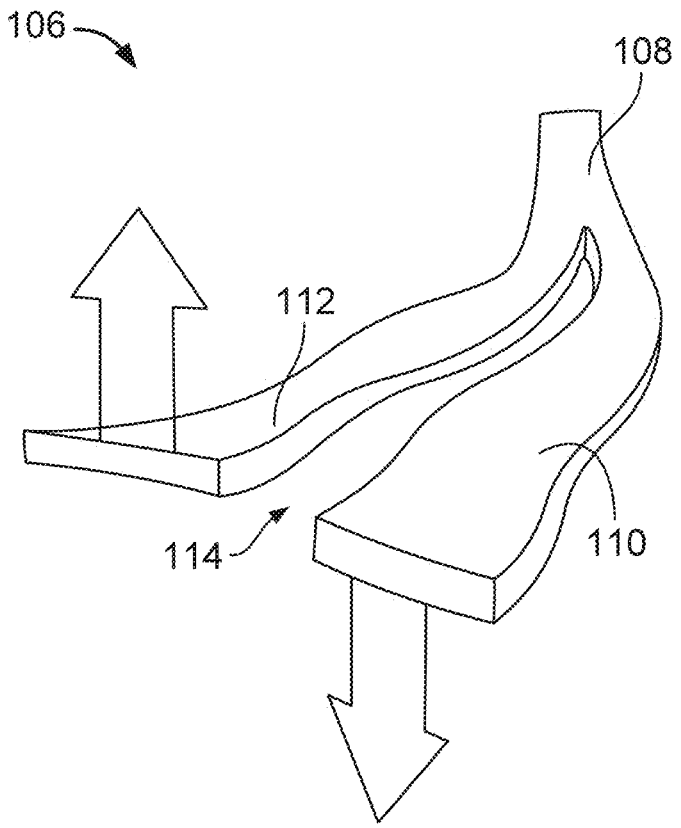
FIG. 4 is a is a front view of a portion of a chassis of the shoe of FIG. 1.
Figure 5:
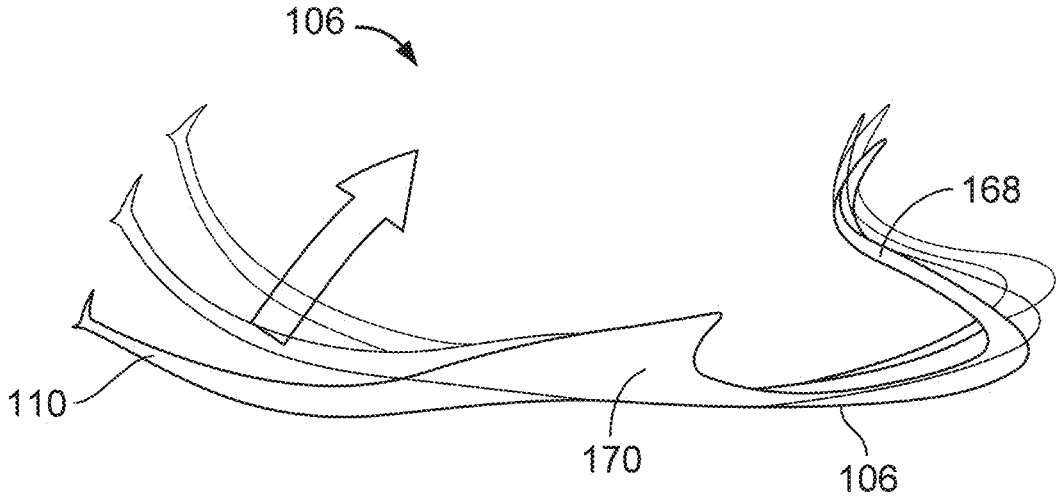
FIG. 5 is a is a lateral side motion view of a portion of a chassis of the shoe of FIG. 1.

Referring now to FIGS. 4 and 5, a portion of the chassis 106 comprising the elongated fork structure is shown. The elongated fork structure provides the article of footwear 100 numerous benefits. For example, the elongated fork structure provides an article of footwear 100 with improved flexibility. With particular reference to FIG. 4, the elongated fork structure provides the article of footwear 100 with greater lateral/medial torsional flexibility, which may be particularly beneficial in athletic shoes. Referring now to FIG. 5, the elongated fork structure provides the article of footwear 100 with greater flexibility for movement in the vertical direction in the forefoot region 144, while simultaneously providing greater rigidity and support in the heel region 140. Additionally, the elongated fork structure of the chassis 106 according to the present disclosure may have relatively few components, may require relatively few materials to manufacture, and reduce assembly time; all of which may beneficially reduce the cost of manufacturing related footwear.

Turning back to FIGS. 1 and 2, the sole structure 102 includes the plurality of pods 124. The plurality of pods 124 have at least a first pod 126, a second pod 128, and third pod 130. The chassis 106 is coupled with the plurality of pods 124. The plurality of pods 124 is coupled with the upper 104.

Each pod in the plurality of pods 124 may have two portions: (1) a pod body, and (2) an optional coating. As used herein, the term "pod body" refers to all portions of the pod 124 other than an optional coating. The pod body forms at least the significant majority of the mass of the pod 124 and provides the pod 124 with its general shape. In pods 124 that have an optional coating, the coating is disposed around the outside surface of its pod body. In pods 124 that do not have a coating, the pod body makes up the entirety of the pod 124, i.e., the pod 124 consists only of a pod body. For these pods 124, the terms "pod body" and "pod" become synonymous and can be used interchangeably.

Each pod 124 is formed from a foam material. More specifically, each pod body is formed from a foam material. The foam material(s) may include any suitable compositions. For example, foam material may be constructed from ethylene-vinyl acetate (EVA), interpolymers that include EVA, or a similar type of material. In some embodiments, the foam material may be an EVA-Solid-Sponge ("ESS") material, an EVA foam (e.g., PUMA® ProFoam Lite™, IGNITE Foam), polyurethane, polyether, an olefin block copolymer, a thermoplastic material (e.g., a thermoplastic polyurethane, a thermoplastic elastomer, a thermoplastic polyolefin, etc.), or a supercritical foam. The foam material may comprise only a single polymeric material or may comprise a blend of materials, such as an EVA copolymer, a thermoplastic polyurethane, a polyether block amide (PEBA) copolymer, and/or an olefin block copolymer.

A foam material may be formed by a supercritical foaming process, such that the foam material form a supercritical foam. The supercritical foam may have micropore foams or particle foams, such as a TPU, EVA, PEBAX®, or mixtures thereof, manufactured using a process that is performed within an autoclave, an injection molding apparatus, or any sufficiently heated/pressurized container that can process the mixing of a supercritical fluid (e.g., $CO_2$, $N_2$, or mixtures thereof) with a material (e.g., TPU, EVA, polyolefin elastomer, or mixtures thereof) that is preferably molten. During an exemplary process, a solution of supercritical fluid and molten material is pumped into a pressurized container, after which the pressure within the container is released, such that the molecules of the supercritical fluid rapidly convert to gas to form small pockets within the material and cause the material to expand into a foam, which may be used in a pod of the present disclosure. In some embodiments, pods of the present disclosure may be formed using alternative methods known in the art, including the use of an expansion press, an injection machine, a pellet expansion process, a cold foaming process, a compression molding technique, die cutting, or any combination thereof. For example, a pod 124 may be formed using a process that involves an initial foaming step in which supercritical gas is used to foam a material and then compression molded or die cut to a particular shape.

Some pod bodies may consist only of a single foam material. However, in some pods 124 each individual pod body may comprise a combination of multiple foam materials.

In pods 124 having an optional coating, the optional coating may be a skin layer disposed around the outside of the pod body. Alternatively, the coating may be added to the outside of the pod body by spraying, extrusion coating, painting, dipping, or any other suitable method. The coating may be made of any materials suitable for a particular application. For example, the coating may include a foam material as described here, where the foam material of the coating is different than the foam material of the pod body. The coating may alter or improve a target property of the pod 124. For example, the coating may provide the pod 124 with any or all of: a harder outer surface, an improved resistance to water, an improved resistance to stains, a higher melting temperature, a higher flashpoint, better bonding properties, and/or a preferable appearance.

A sole structure 102 may have pods 124 made from a number of different foam materials. For example, one pod 124 may be made of a foam material that is different from the foam material of any of the other pods 124. Further, a sole structure may have a plurality of pods 124 in which every pod 124 is made from a foam material that is different than the foam material of every other pod 124. Put another way, in such an embodiment, each pod 124 is made of a unique foam material. For example, in the article of footwear 100 shown in FIGS. 1 and 2, the first pod 126 may be formed from a first foam material, the second pod 128 may be formed from a different second form material, and the third pod 130 may formed from still another different third foam material.

Figure 6:
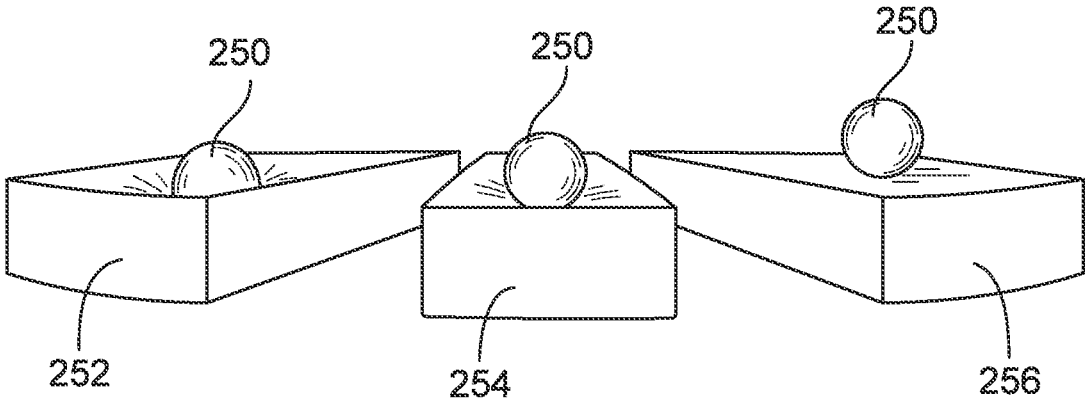
FIG. 6 is a representation of three types of foam material that may be suitable for use in an article of footwear as discussed herein.

It is often especially useful if the different foam materials used to make a plurality of pods 124 vary in density, hardness, and/or elasticity. Referring now to FIG. 6, a weight 250 and three different types of foam material, formed into wedge shapes (252, 254, and 256 respectively), are shown. The weight 250 is shown resting on the top surface of each wedge (252, 254, and 256 respectively) of foam material. The foam material in wedge 252 is less dense than the foam material in wedge 254, which in turn is less dense than the foam material in wedge 256. The differences in density cause the weight 250 to compresses the wedge 252 to a greater degree than it does the wedge 254. The weight 250 compresses the wedge 256 even less than it does the wedge 254, the weight appearing to have little if any compressive impact upon wedge 256. As such, the foam material of wedge 256 may be particularly useful in components of an article of footwear that tend to be load bearing and therefore need to provide support, whereas the foam material of wedge 252 may be particularly useful in components of an article of footwear that tend to experience high amounts of impact force and therefore need to provide cushioning. A particular foam material may have a density within the range between about 0.05 grams per cubic centimeter ($g/cm^3$) and about 0.50 $g/cm^3$, or between about 0.20 $g/cm^3$ and about 0.40 $g/cm^3$. The foam material of particular pods may have a Shore A hardness between about 45 and about 60.

Further, the sole structure 102 may have a plurality of pods 124 in which some of the pods 124 form a group, wherein each pod 124 in the group is made of the same foam material. Some sole structures 102 may have pods 124 that form multiple groups, wherein the pods 124 in a given group are all made of a single foam material, but every group uses a different foam material. For example, a plurality of pods 124 may be formed from three foam materials (1, 2, and 3), such that the pods 124 form three groups (A, B, and C), wherein the pods 124 of Group A all use foam material 1, the pods 124 of Group B all use foam material 2, and the pods 124 of Group C all use foam material 3.

The pods 124 in a group may all be positioned near each other, may be located in multiple clusters, or may be spread randomly throughout a sole structure. It may be beneficial to cluster certain groups of pods 124 together, in particular areas of the sole structure. For example, it may be useful to position a group of pods 124 made from a foam material having certain properties in the forefoot region 144, while clustering other pods 124 that are made from a foam material having different properties in the heel region 140, so that different parts of a single sole structure can provide different amounts of properties such as support, cushioning, impact absorption, and/or stain resistances, as may be useful. It may be beneficial to position pods 124 that provide greater amounts of support in the heel region 140, whereas it may be beneficial to position pods 124 with greater impact absorption in the forefoot region 144. A sole structure 102 may comprise any number of such groups of pods 124 (each group made of a single foam material or combination of foam materials), positioned throughout the sole structure 102 using any suitable design.

Positioning of pods 124 having certain properties that are particularly suitable to certain regions of a sole structure may also occur with single pods 124. When only a single pod 124 is positioned in a particular region of a sole structure, it is typically larger than pods 124 that are positioned in groups. For example, in one embodiment, a single pod 124 may occupy, e.g., contact directly or indirectly, at least 50% of the surface area of the bottom surface of the upper 104 in a given region. In another embodiment, a single pod 124 may occupy at least 70%, or at least 80%, or at least 90% of the surface area of the bottom surface of the upper 104 in a given region. Additionally, a single pod 124 may occupy substantially all of the surface area of the bottom surface of the upper 104 in a given region.

FIGS. 1 and 2 depict an embodiment using larger pods 124, as described above. Each pod in the plurality of pods 124 (i.e. the first pod 126, the second pod 128, and the third pod 130) has a substantially elongated shape. Additionally, each pod in the plurality of pods 124 is positioned in a particular (and different) region of the article of footwear 100. The first pod 126 is positioned in the heel region 140, the second pod 128 is positioned in the midfoot region 142, and third pod 130 is positioned in the forefoot region 144. Each pod 124 runs along substantially the entire longitudinal length of its respective region, as measured along longitudinal, central axis 152. With particular reference to FIG. 2, each pod 124 also runs across substantially the entire width of the article of footwear 100, from the lateral side 162 to the medial side 160, in its respective region.

The first, second, and third pods (126, 128, 130) have different densities such that: $1^{st}$ pod density>$2^{nd}$ pod density>$3^{rd}$ pod density. The first pod 126 is positioned substantially in a heel region 140, the second 128 pod is positioned substantially in a midfoot region 142, and the third pod 130 is positioned substantially in a forefoot region 144. This arrangement is a particularly beneficial way to provide superior support to a user's foot in the heel region, which often receives a disproportionately large amount of a user's weight, while also providing superior impact absorption in the forefoot region, which often experiences a disproportionately large amount of impact force during use, such as running.

Figure 7:
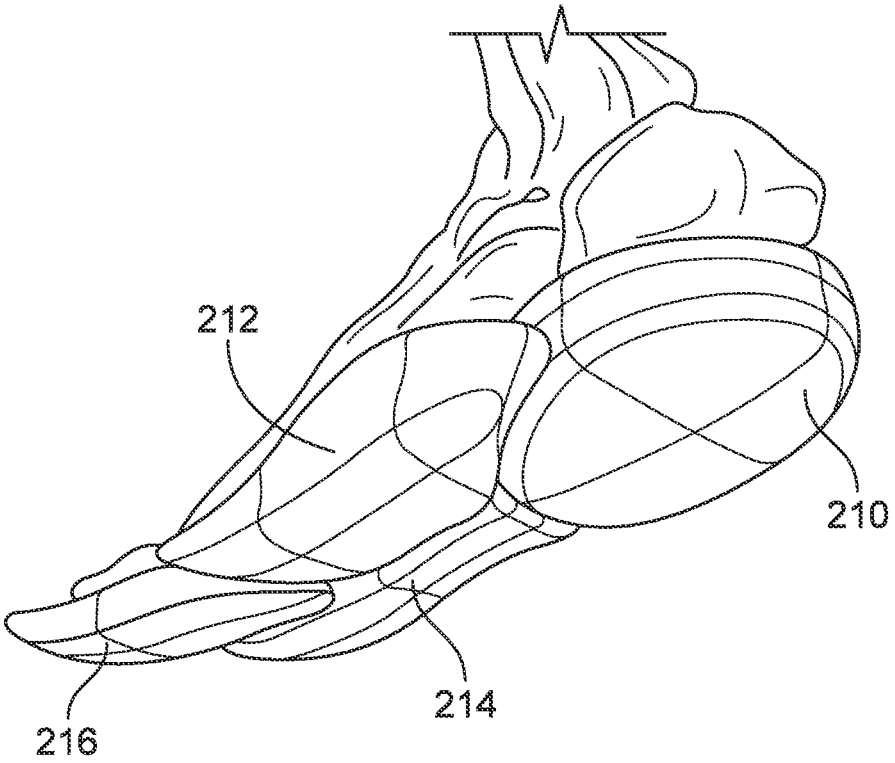
FIG. 7 is a bottom perspective view of pods according to an embodiment of the present disclosure, shown in arrangement contacting a user's skeletal foot structure.

Referring now to FIG. 7, a plurality of pods 124 are shown, the pods 124 disposed on the bottom surface of a skeletal representation of a foot of a user. The plurality of pods 124 includes four pods, a first pod 210, a second pod 212, a third pod 214, and a fourth pod 216. The first pod 210 has a substantially cylindrical shape and is disposed proximate the heel of the user's foot, i.e. in a heel region. The second pod 212 has a substantially elongated shape and is disposed along a medial portion of a midfoot region of the user's foot. The third pod 214 also has a substantially elongated shape and is disposed along lateral portions of the midfoot and forefoot regions of a user's foot. The fourth pod 216 has a substantially elongated shape and is disposed along a medial portion of the forefoot region of a user's foot. A plurality of pods may have 5 pods, 6 pods, 7 pods, 8 pods, 9 pods, 10 pods, or any number of pods suitable for a particular application. The first pod 210 may be formed from a relatively dense foam material (such as the foam material of wedge 256) to provide superior support, whereas the fourth pod 216 may be formed from a foam material with relatively low density (such as the foam material of wedge 252) to provide superior cushioning. The second pod 212 and the third pod 214 may be formed from one or more foam material(s) have a mid-range density (in comparison to the foam material of the first pod 210 and the fourth pod 216) to provide a balance of support/cushioning properties. The second pod 212 and the third pod 214 may be formed from the same foam material. Alternatively, the second pod 212 and the third pod 214 may be made from different foam materials.

Referring back to FIGS. 1 and 2, the upper 104 is shown disposed above and coupled with the sole structure 102. The upper 104 may be attached to the sole structure via adhesive or stitching. The upper 104 could be formed conventionally from multiple elements, e.g., textiles, polymer foam, polymer sheets, leather, or synthetic leather, which are joined through bonding or stitching at a seam. In some embodiments, the upper 104 of the article of footwear 100 is formed from a knitted structure or knitted components. In various embodiments, a knitted component may incorporate various types of yarn that may provide different properties to an upper. For example, an upper mesh layer may be warp knit, while a mesh backing layer may comprise a circular knit.

The upper 104 extends along the lateral side 162 and the medial side, and across the heel region 140, the midfoot region 142, and the forefoot region 144 to house and enclose a foot of a user. When fully assembled, the upper 104 also includes the interior surface 172 and the exterior surface 174. The interior surface 172 faces inward and generally defines the interior cavity 176, and the exterior surface 174 of the upper 104 faces outward and generally defines an outer perimeter or boundary of the upper 104. The interior surface 172 and the exterior surface 174 may include portions of the upper layers disclosed above. The upper 104 also includes an opening that is at least partially located in the heel region 140 of the article of footwear 100, that provides access to the interior cavity 176 and through which a foot may be inserted and removed.

In some embodiments, various layers of the upper 104 are heat pressed together so as to bond the various layers of the upper 104. For example, layers that comprise the upper 104 can be heat pressed together all at once and at a single temperature. Various layers of the upper 104 may be waterproof or semi-waterproof, and may include a plurality of layers of mesh or other materials. The materials that comprise the upper 104 may include an inner mesh layer, a thermoplastic polyurethane (TPU) film, and an outer mesh layer. A TPU skin may be applied along the outer surface of the upper.

With reference to the material, or materials, that form the upper 104, the specific properties that a particular type of yarn will impart to an area of a knitted component may at least partially depend upon the materials that form the various filaments and fibers of the yarn. For example, cotton may provide a soft effect, biodegradability, or a natural aesthetic to a knitted material. Elastane and stretch polyester may each provide a knitted component with a desired elasticity and recovery. Rayon may provide a high luster and moisture absorbent material, wool may provide a material with an increased moisture absorbance, nylon may be a durable material that is abrasion-resistant, and polyester may provide a hydrophobic, durable material.

Other aspects of a knitted component may also be varied to affect the properties of the knitted component and provide desired attributes. For example, a yarn forming a knitted component may include monofilament yarn or multifilament yarn, or the yarn may include filaments that are each formed of two or more different materials. In addition, a knitted component may be formed using a particular knitting process to impart an area of a knitted component with particular properties. Accordingly, both the materials forming the yarn and other aspects of the yarn may be selected to impart a variety of properties to particular areas of the upper 104.

An elasticity of a knit structure may be measured based on comparing a width or length of the knit structure in a first, non-stretched state to a width or length of the knit structure in a second, stretched state after the knit structure has a force applied to the knit structure in a lateral direction.

In some instances, other elements, e.g., plastic material, logos, trademarks, etc., may also be applied and fixed to an exterior surface using glue or a thermoforming process. The properties associated with an upper, e.g., a stitch type, a yarn type, or characteristics associated with different stitch types or yarn types, such as elasticity, aesthetic appearance, thickness, air permeability, or scuff-resistance, may be varied.

The article of footwear 100 may also include a tightening system, such as a system that includes a lace and a plurality of eyelets. The tightening system may be a hook-and-loop fastening system, such as Velcro®. Alternatively, the tightening system may be any other laceless fastening system known in the art. Still further, the tightening system may include a different manual lacing system, a rotary closure device, or an automatic lacing system, such as the lacing systems described in U.S. patent application Ser. No. 15/780,368, filed on May 31, 2018, now issued as U.S. Pat. No. 10,758,011, and U.S. patent application Ser. No. 16/392,470, filed on Apr. 23, 2019, now issued as U.S. Pat. No. 11,033,079, both of which are hereby incorporated by reference in their entirety.

Referring now to FIGS. 8 and 9, a particular article of footwear 300 is shown. The article of footwear 300 is substantially similar to the article of footwear 100 (with corresponding elements having corresponding reference numerals, in the 300 series). For example, the article of footwear 100 has a sole structure 102 and an upper 104 and the article of footwear 300 has a sole structure 302 an upper 304. Like the sole structure 102, the sole structure 302 also includes a chassis 306 having a chassis stem 308, a first chassis leg 310, a second chassis leg 312, and a continuous elongated groove 314. The continuous elongated groove 314 has a first end 316, a second end 318, a heel joint 320, and a toe joint 322. The sole structure 302 also includes a plurality of pods 324. The chassis 306 is coupled with the plurality of pods 324. The plurality of pods 324 is connected directly with the upper 304. The primary difference between article of footwear 100 and article of footwear 300 is that the sole structure 302 encapsulates a plurality of pods 324. As used herein the term "encapsulate" means to surround most or all of an object. For example, a case that surrounds an object on substantially all sides but which has an opening/aperture, would still be said to encapsulate the object. The sole structure 302 also includes a plurality of capsule(s) 372 that surround(s) the pods 324. The article of footwear 300 has a heel region 340, a midfoot region 342, and a forefoot region 344 and that are substantially similar to the heel/midfoot/forefoot regions of the article of footwear 100 described above. The article of footwear 300 also has a medial side (not shown) and a lateral side 362 that are substantially similar to the medial/lateral sides of the article of footwear 100 described above.

The continuous elongated groove 314 is disposed such that it does not extend through the entire thickness of the chassis 306 but rather comprises a reduced thickness region (as described in more detail above) of the chassis 306 along substantially the entire length of the continuous elongated groove 314.

The chassis 306 encapsulates each pod in the plurality of pods 324. The chassis 306 may encapsulate each pod 324 within its own capsule 372. Alternatively, the chassis 306 could encapsulate all of the pods 324 in a single capsule 372. In some implementations, the chassis 306 may encapsulate some pods 324 that are located proximate each other into a joint capsule, such that there are multiple joint capsules that each contain multiple pods within a single sole structure 302. In particular embodiments, the chassis 306 encapsulates each of the pods in the plurality of pods 324 without retaining any fluid, including any air, within any of the capsules 372.

The chassis 306 may also include additional optional components, such as a plurality of flex grooves. The flex grooves 374 may be disposed on lateral side 362 of the article of footwear 300, on the medial side (not shown) of the article of footwear 300, or both. The plurality of flex grooves 374 may include any number of individual flex grooves 374 suitable. In the embodiment shown in FIG. 8, the chassis 306 has a plurality of flex grooves 374 that includes four individual flex grooves 374. Beneficially, the plurality of flex grooves 374 provide the article of footwear 300 with added flexibility, which may be particularly important in embodiments that employ a chassis 306 having a greater thickness. For example, a plurality of flex grooves 374 may be particularly useful in embodiments having a sole structure 302 that includes a chassis 306 that encapsulates a plurality of pods 324, as such encapsulation may tend to increase the thickness of the sole structure 302.

Still referring to FIGS. 8 and 9, at least a portion of the chassis 306 comprises a translucent material. In some embodiments, at least the portion of the chassis 306 that encapsulates the plurality of pods 324, i.e., the portion(s) of the chassis 306 that form the capsules 372, is made from a translucent material, such that the pods are visible through the chassis 306. As shown in FIGS. 8 and 9, portions of the chassis 306 are made from a translucent material, such that the pods can be seen through a lateral side 362 of the chassis 306 (as shown in FIG. 8) and through portions of the bottom surface of the chassis 306 (as shown in FIG. 9).

Figure 10:
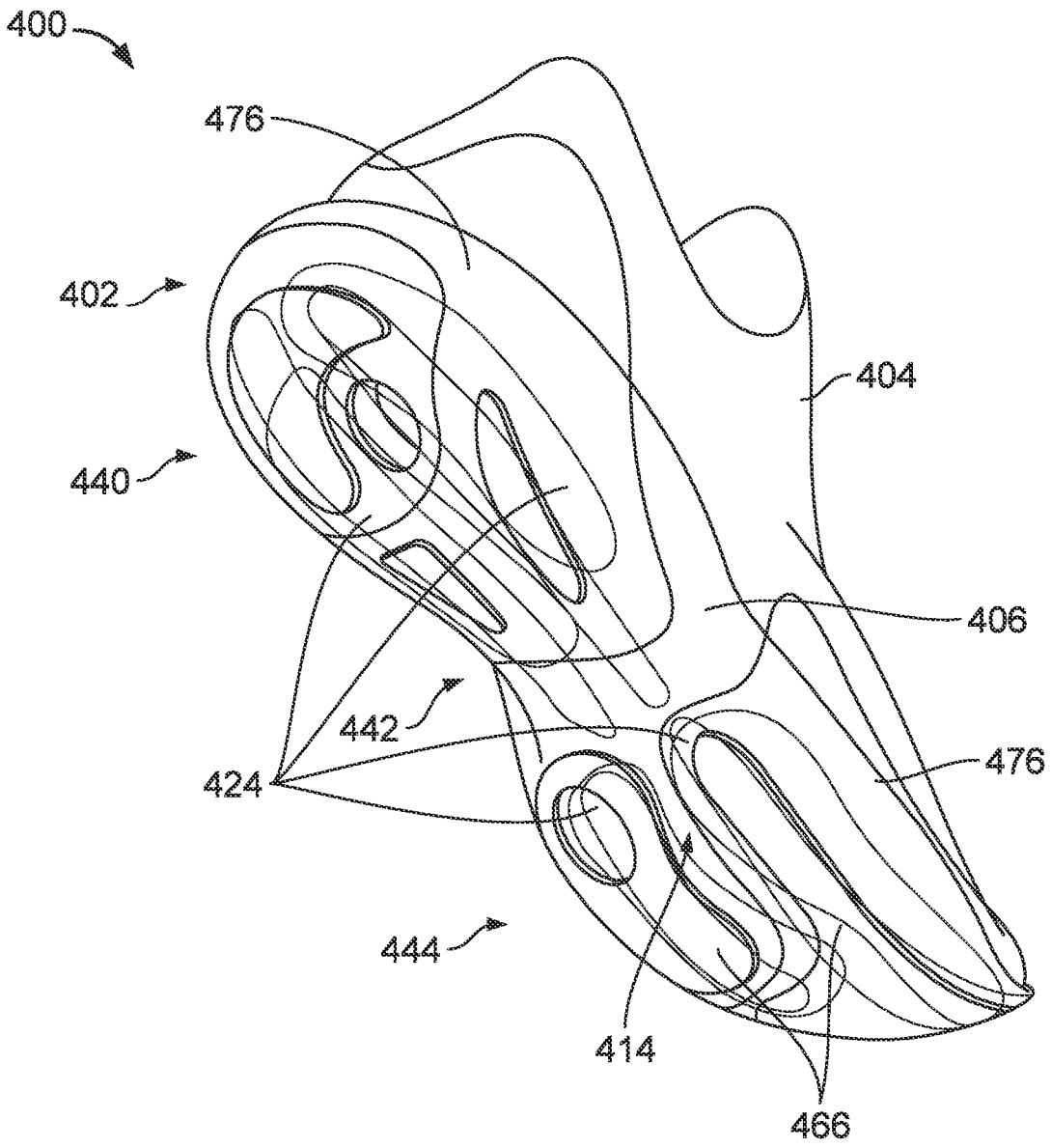
FIG. 10 is a bottom perspective view of an article of footwear configured according to an embodiment of the present disclosure.
Figure 11:
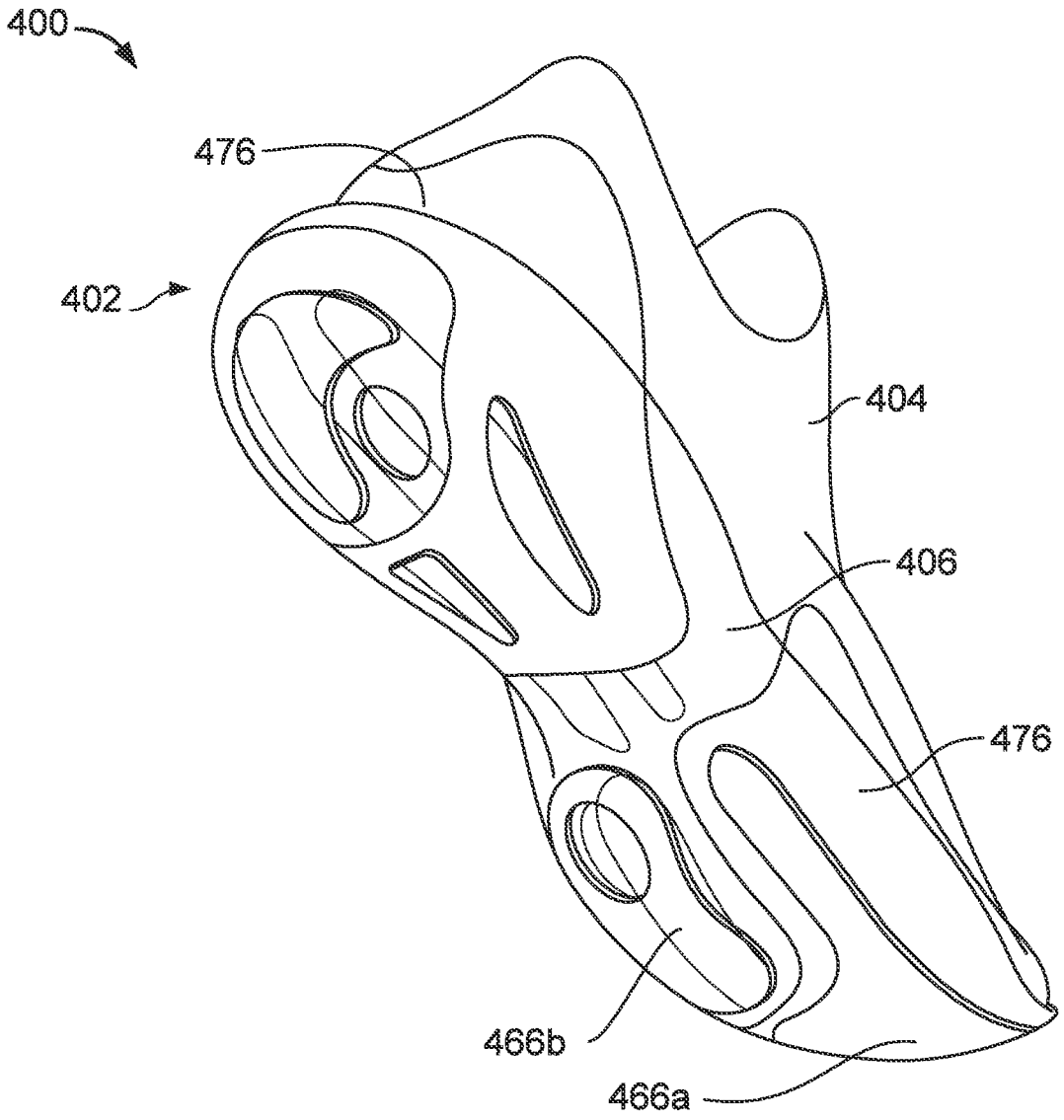
FIG. 11 is a bottom perspective view of yet an article of footwear configured according to an embodiment of the present disclosure.

Moving now to FIGS. 10 and 11, an article of footwear 400 is shown. The article of footwear 400 is substantially similar to the article of footwear 300 (with corresponding elements having corresponding reference numerals, in the 400 series). For example, the article of footwear 300 has a sole structure 302 and an upper 304, and the article of footwear 400 has a sole structure 402 an upper 404. Like the sole structure 302, the sole structure 402 also includes a chassis 406 having a chassis stem, a first chassis leg, a second chassis leg, and a continuous elongated groove 414. The sole structure 402 also includes a plurality of pods 424. The chassis 406 is coupled with the plurality of pods 424. The plurality of pods 424 is connected directly with the upper 404. The primary difference between article of footwear 300 and article of footwear 400 is that the article of footwear 400 includes a sole structure 402 with a chassis 406 that is formed from a "soft chassis material" and also has hard chassis coverings 476. Similar to the chassis 306 of the article of footwear 300, described above, the chassis 406 encapsulates the plurality of pods 424. The "soft chassis material" and/or the hard chassis coverings 476 may be formed from a translucent material. The article upper 404 may be similar to the upper 104, described above. The article of footwear 400 has a heel region 440, a midfoot region 442, and, a forefoot region 444 that are substantially similar to the heel/midfoot/forefoot regions described above, with reference to the article of footwear 100.

The soft chassis material may be any suitable material, for example, the soft chassis material may be a rubber (such as silicon rubber) or a thermoplastic elastomer (TPE) such as styrenic block copolymers, polyamides, or polyurethanes, or other similar materials. The hard chassis covering 476 may be any suitable material, for example, the hard chassis covering 476 may be polyvinyl chloride (PVC), polyethylene terephthalate PET), or high-density polyethylene, or other similar materials The hard chassis covering 476 may include ground contacting regions 466. Ground contacting regions 466 may also comprise traction pads, as described above. In some embodiments, the hard chassis covering 476 may comprise portions of a ground contacting region 466, such that hard chassis covering 476 partially or completely surrounds one or more traction pads. In some embodiments, portions of a ground contacting region 466 comprise a traction pad that is not surrounded by the hard chassis covering 476. For example, as best shown in FIG. 11, a portion of the hard chassis covering 476 comprises a portion of a ground contacting region 466 that completely surrounds traction pad 466*a*. However, another ground contacting region 466 comprises traction pad 466*b*, which is not surrounded by the hard chassis covering 476.

Any of the embodiments described herein may be modified to include any of the structures or methodologies disclosed in connection with different embodiments. Similarly, materials or construction techniques other than those disclosed above may be substituted or added in some embodiments according to known approaches. Further, the present disclosure is not limited to articles of footwear of the type specifically shown. Still further, aspects of the articles of footwear of any of the embodiments disclosed herein may be modified to work with any type of footwear, apparel, or other athletic equipment.

As noted previously, it will be appreciated by those skilled in the art that while the disclosure has been described above in connection with particular embodiments and examples, the disclosure is not necessarily so limited, and that numerous other embodiments, examples, uses, modifications and departures from the embodiments, examples and uses are intended to be encompassed by the claims attached hereto.

We claim:

1. An article of footwear, comprising:

an upper; and a sole structure coupled with the upper, the sole structure defining a forefoot region, a midfoot region that corresponds with a portion of the article of footwear that is configured to encase an arch of a foot, and a heel region that is proximate and adjoining the midfoot region, the sole structure comprising:

a plurality of pods, each pod having a pod body and optionally having a coating disposed on an outer surface of the pod body; and a chassis attached to a bottom surface of each pod in the plurality of pods, wherein the pod body of each pod in the plurality of pods comprises a foam material, wherein the chassis comprises a plurality of ground contacting regions, and wherein the chassis has an elongated fork structure, the elongated fork structure comprising:

a chassis stem;

a first chassis leg extending from the chassis stem through the heel region, the midfoot region, and the forefoot region of the sole structure;

a second chassis leg extending from the chassis stem through the heel region, the midfoot region, and the forefoot region of the sole structure; and a continuous elongated groove positioned between the first chassis leg and the second chassis leg, the continuous elongated groove extending along substantially the entire length of the first chassis leg and the second chassis leg, wherein the upper has a bottom surface that defines a bottom surface area and each pod in the plurality of pods has a top surface, wherein a portion of the top surface of each pod in the plurality of pods is attached to a portion of the bottom surface of the upper, and wherein in a majority of the bottom surface area, the bottom surface of the upper contacts the top surface of a pod in the plurality of pods.

2. The article of footwear of claim 1, wherein the pod body of each pod in the plurality of pods consists of the foam material.

3. The article of footwear of claim 2, wherein the foam material in the pod body of at least one pod in the plurality of pods has a density that is different from a density of the foam material in the pod body of at least one other pod in the plurality of pods.

4. The article of footwear of claim 3, wherein the foam material in the pod body of each pod in the plurality of pods has a density that is different from the density of the foam material in the pod body of every other pod in the plurality of pods.

5. The article of footwear of claim 1, wherein the plurality of pods comprises at least a first pod, a second pod, and a third pod, and wherein a density of the foam material in the pod body of the first pod is greater than a density of the foam material in the pod body of the second pod, wherein the density of the foam material in the pod body of the second pod is greater than a density of the foam material in the pod body of the third pod, and wherein the first pod is positioned substantially in the heel region of the sole structure, the second pod is positioned substantially in the midfoot region of the sole structure, and the third pod is positioned substantially in the forefoot region of the sole structure.

6. The article of footwear of claim 1, wherein the chassis has an elongated fork structure, the chassis is not directly attached to the upper.

7. The article of footwear of claim 1, wherein the chassis comprises a support fin extending upward from the first chassis leg in the midfoot region of the sole structure.

8. An article of footwear, comprising:

an upper; and a sole structure coupled with the upper, the sole structure defining a forefoot region, a midfoot region, and a heel region, the sole structure comprising:

a plurality of pods, each pod having a pod body and optionally having a coating disposed on an outer surface of the pod body; and a chassis attached to a bottom surface of each pod in the plurality of pods, wherein the pod body of each pod in the plurality of pods comprises a foam material, wherein the foam material in the pod body of at least one pod in the plurality of pods has a density that is different than a density of the foam material in the pod body of at least one other pod in the plurality of pods, wherein the chassis comprises a plurality of ground contacting regions, wherein the chassis is a single unitary piece that is integrally formed from a single material, and wherein the chassis comprises a heel support plate extending upward from a chassis stem.

9. The article of footwear of claim 8, wherein the foam material in the pod body of each pod in the plurality of pods has a density that is different from the density of the foam material in the pod body of every other pod in the plurality of pods.

10. The article of footwear of claim 8, wherein the plurality of pods comprises at least a first pod, a second pod, and a third pod, and wherein a density of the foam material in the pod body of the first pod is greater than a density of the foam material in the pod body of the second pod, wherein the density of the foam material in the pod body of the second pod is greater than a density of the foam material in the pod body of the third pod, and wherein the first pod is positioned substantially in the heel region of the sole structure, the second pod is positioned substantially in the midfoot region of the sole structure, and the third pod is positioned substantially in the forefoot region of the sole structure.

11. The article of footwear of claim 8, wherein the upper has a bottom surface and each pod in the plurality of pods has a top surface, and wherein the top surface of each pod in the plurality of pods is attached to the bottom surface of the upper.

12. The article of footwear of claim 11, wherein the bottom surface of the upper defines a bottom surface area, and wherein in a majority of the bottom surface area, the bottom surface of the upper contacts the top surface of a pod in the plurality of pods.

13. The article of footwear of claim 11, wherein the elongated fork structure comprises:

a first chassis leg extending from the chassis stem through the heel region, the midfoot region, and the forefoot region of the sole structure;

a second chassis leg extending from the chassis stem through the heel region, the midfoot region, and the forefoot region of the sole structure; and a continuous elongated groove positioned between the first chassis leg and the second chassis leg, the continuous elongated groove extending along substantially the entire length of the first chassis leg and the second chassis leg.

14. An article of footwear, comprising:

an upper; and a sole structure coupled with the upper, the sole structure defining a forefoot region, a midfoot region, and a heel region, the sole structure comprising:

a plurality of pods, each pod having a pod body and optionally having a coating disposed on an outer surface of the pod body; and a chassis attached to a bottom surface of each pod in the plurality of pods, wherein the pod body of each pod in the plurality of pods comprises a foam material, wherein the foam material in the pod body of at least one pod in the plurality of pods has a density that is different than a density of the foam material in the pod body of at least one other pod in the plurality of pods, wherein the chassis at least partially encapsulates each pod in the plurality of pods, wherein the chassis comprises a plurality of ground contacting regions, and wherein the chassis is not directly attached to the upper.

15. The article of footwear of claim 14, wherein the chassis is indirectly coupled to the upper by way of the plurality of pods.

16. The article of footwear of claim 14, wherein the chassis has an elongated fork structure, the elongated fork structure comprising:

a chassis stem;

a first chassis leg extending from the chassis stem through the heel region, the midfoot region, and the forefoot region of the sole structure;

a second chassis leg extending from the chassis stem through the heel region, the midfoot region, and the forefoot region of the sole structure; and a continuous elongated groove positioned between the first chassis leg and the second chassis leg, the continuous elongated groove extending along substantially the entire length of the first chassis leg and the second chassis leg.

* * * * *